US007025418B1

(12) United States Patent
Hackal

(10) Patent No.: US 7,025,418 B1
(45) Date of Patent: Apr. 11, 2006

(54) POSITIONABLE FLOATING CHAIR

(76) Inventor: Mike Hackal, 220 Hidden Acres Path, Wading River, NY (US) 11792

( * ) Notice: Subject to any disclaimer, the term of this patent is extended or adjusted under 35 U.S.C. 154(b) by 0 days.

(21) Appl. No.: 11/173,692

(22) Filed: Jul. 1, 2005

(51) Int. Cl.
*A47C 31/00* (2006.01)

(52) U.S. Cl. ..... 297/217.3; 297/184.1; 297/377; 441/130

(58) Field of Classification Search ..... 297/217.3, 297/217.1, 463.2, 377, 184.1; 441/130, 131, 441/132
See application file for complete search history.

(56) References Cited

U.S. PATENT DOCUMENTS

| | | | | |
|---|---|---|---|---|
| 3,117,327 | A * | 1/1964 | Mathew | 441/132 |
| 3,908,666 | A | 9/1975 | Osborne | |
| 3,984,888 | A * | 10/1976 | DeLano | 441/132 |
| 4,115,888 | A * | 9/1978 | Sievers | 440/38 |
| 4,379,588 | A | 4/1983 | Speice | |
| 4,441,220 | A | 4/1984 | Peterson | |
| 4,597,119 | A | 7/1986 | Padgett | |
| 4,662,852 | A * | 5/1987 | Schneider et al. | 441/132 |
| 4,933,618 | A | 6/1990 | Ortlieb | |
| 5,078,451 | A | 1/1992 | Sobel | |
| 5,211,172 | A | 5/1993 | McGuane et al. | |
| 5,403,220 | A | 4/1995 | Goad, Sr. | |
| 5,681,089 | A * | 10/1997 | Lin | 297/440.1 |
| 5,893,608 | A | 4/1999 | Cravenor | |
| 5,944,384 | A | 8/1999 | Patterson | |
| 5,967,601 | A * | 10/1999 | Gillins | 297/184.15 |
| 5,975,630 | A * | 11/1999 | Schreiber | 297/217.3 |
| 6,045,423 | A | 4/2000 | Silvia | |
| 6,312,054 | B1 * | 11/2001 | Scheurer et al. | 297/373 |
| 6,773,319 | B1 * | 8/2004 | Carlini, Jr. | 441/130 |

* cited by examiner

*Primary Examiner*—Milton Nelson, Jr.
(74) *Attorney, Agent, or Firm*—Dale J. Ream

(57) ABSTRACT

A floating chair includes a buoyant member attached to a seat member ("seat") for maintaining the seat above water. A maneuvering device is operatively attached to the seat. A battery and a CPU are in communication with the maneuvering device. A solar panel is in communication with the CPU for conveying sun location data to the CPU, and the solar panel may be electrically connected to the battery for charging the battery with solar energy. The CPU may determine the position of the seat relative to the sun or a remote object and actuate the maneuvering device to maintain the seat in a constant position relative to either. Further, the CPU may actuate the maneuvering device to move the seat in a clockwise direction, a counterclockwise direction, or laterally. When the floating chair is not in use, the seat may be moved from a lounging configuration to a storage configuration.

20 Claims, 9 Drawing Sheets

POSITIONABLE FLOATING CHAIR

BACKGROUND OF THE INVENTION

This invention relates generally to a floating chair. In particular, the present invention relates to a floating chair that can automatically maintain its orientation relative to the sun and that can be easily maneuvered.

Sunbathing and water activities are some of the most popular pastimes around the world. Combining the two activities has heretofore included shortcomings, however. For starters, traditional pool chairs tend to drift. Compounding this problem, the position of the earth relative to the sun moves as well. When it is further considered that different people like to sunbathe differently—many sunbathers like to stay in full sun, while other sunbathers wish to remain in the sunlight, but not in direct sunlight—a single product that addresses all of these shortcomings has been absent.

Various proposals for floating chairs are found in the art, and U.S. Pat. No. 5,403,220 discloses a jet-propelled floating chair. While assumably effective for their intended purposes, the existing devices do not provide a floating chair that can automatically maintain its orientation relative to the sun and that can be easily maneuvered. For the reasons discussed above, these features would be advantageous. Therefore, it would be desirable to have a floating chair having these features.

SUMMARY OF THE INVENTION

A floating chair according to the present invention includes a seat member for supporting a person and a buoyant member attached to the seat member for maintaining the seat member above a water surface. The seat member may comprise a back portion that is pivotal relative to a leg portion for allowing the seat member to move between a lounging configuration and a storage configuration. An adjustment arm may be pivotally coupled to the seat member for allowing the seat member back portion to be selectively positioned at a plurality of recumbent positions.

At least one maneuvering device is operatively attached to the seat member and located below the seat member bottom side. A battery is in communication with each maneuvering device for energizing each maneuvering device, and a CPU is in communication with each maneuvering device for selectively actuating each maneuvering device. A solar panel is in communication with the CPU for detecting the location of the sun and conveying sun location data to the CPU, and the solar panel may be electrically connected to the battery for charging the battery with solar energy.

The CPU may include circuitry or programming in communication with the solar panel for determining the position of the seat member relative to the sun and circuitry or programming for automatically actuating at least one maneuvering device to maintain the seat member in a constant position relative to the sun. The CPU may also include circuitry or programming in communication with the solar panel for determining the position of the seat member relative to a remote object and circuitry or programming for automatically actuating at least one maneuvering device to maintain the seat member in a constant position relative to the remote object. Further, the CPU may include circuitry or programming for actuating at least one maneuvering device to move the seat member in a clockwise direction, a counterclockwise direction, laterally left, or laterally right.

In use, the floating chair is placed on water, such as a pool, a lake, or an ocean, with the seat member in the lounging configuration. The user may use an input device to control the movement of the seat member through the CPU. When the floating chair is not in use, the seat member may be moved from the lounging configuration to the storage configuration. When the seat member is at the storage configuration, the floating chair is compact and requires minimal storage space.

Therefore, a general object of this invention is to provide a chair that floats on water.

Another object of this invention is to provide a floating chair, as aforesaid, that tracks the position of the sun and automatically adjusts its own position relative to the sun.

Still another object of this invention is to provide a floating chair, as aforesaid, that uses solar energy to adjust its position.

Yet another object of this invention is to provide a floating chair, as aforesaid, that is comfortable and stable.

A further object of this invention is to provide a floating chair, as aforesaid, that is mobile and may be easily transported.

A still further object of this invention is to provide a floating chair, as aforesaid, that is easy and safe to operate.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1A:
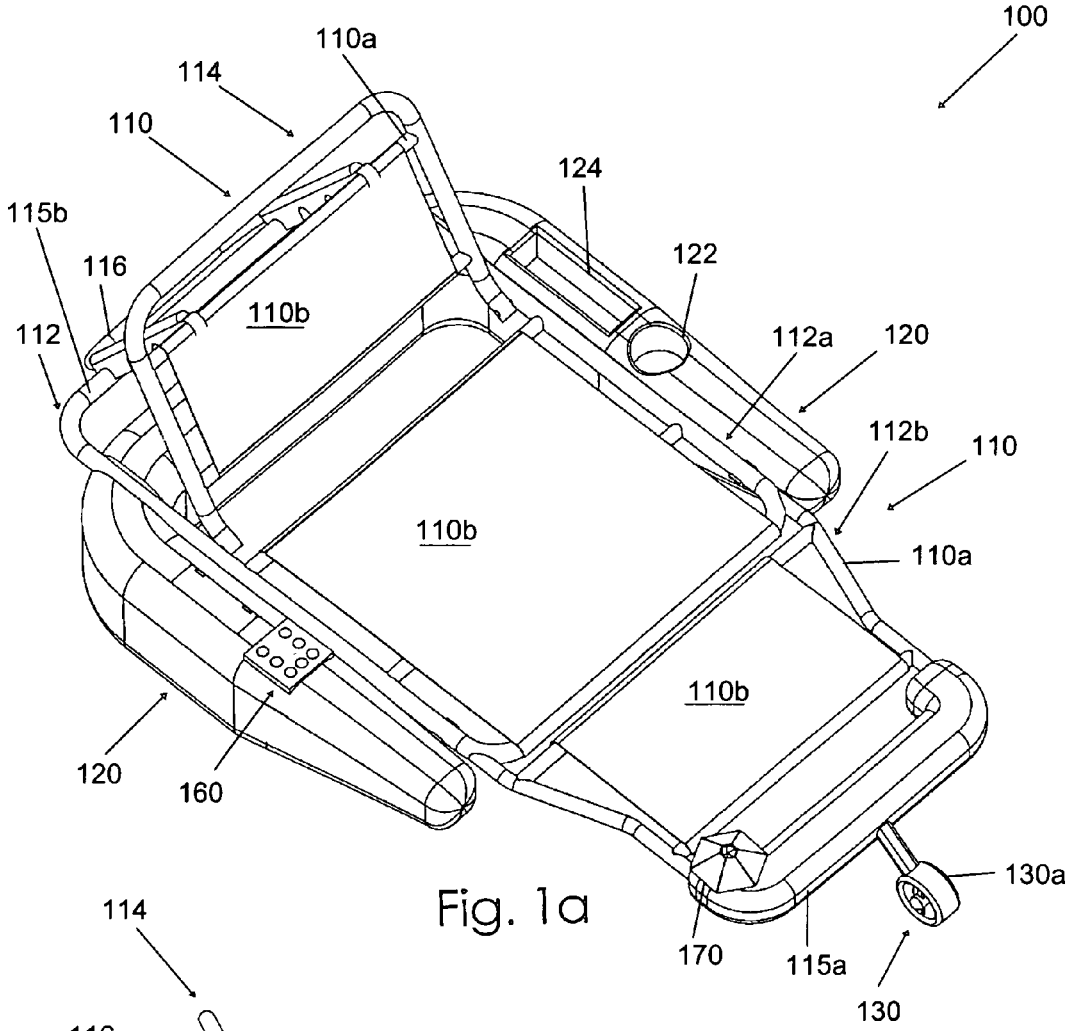
FIG. 1*a* is a perspective view of a floating chair according to the present invention.
Figure 1B:
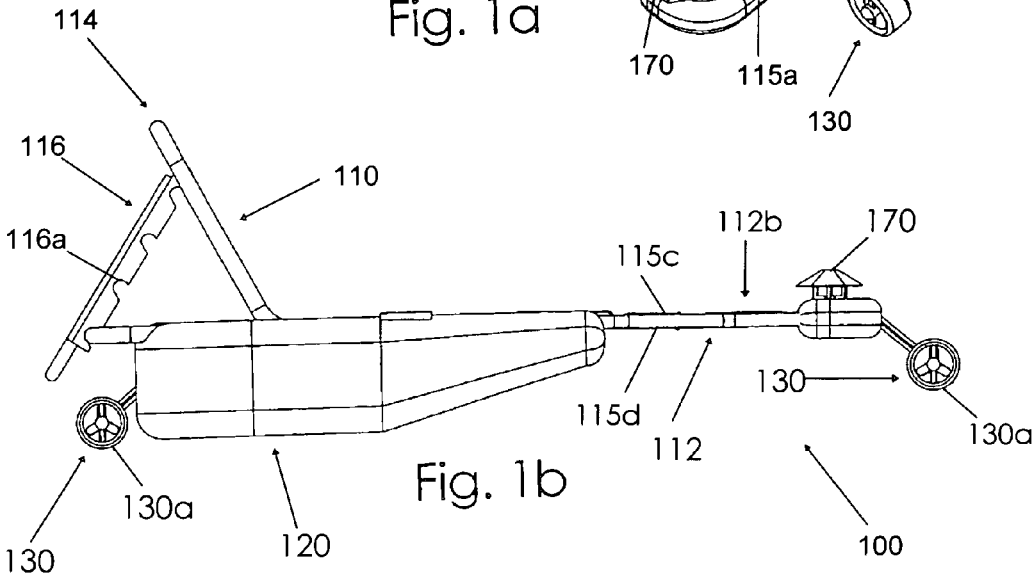
FIG. 1*b* is a side view of the floating chair as in FIG. 1*a;*
Figure 2A:
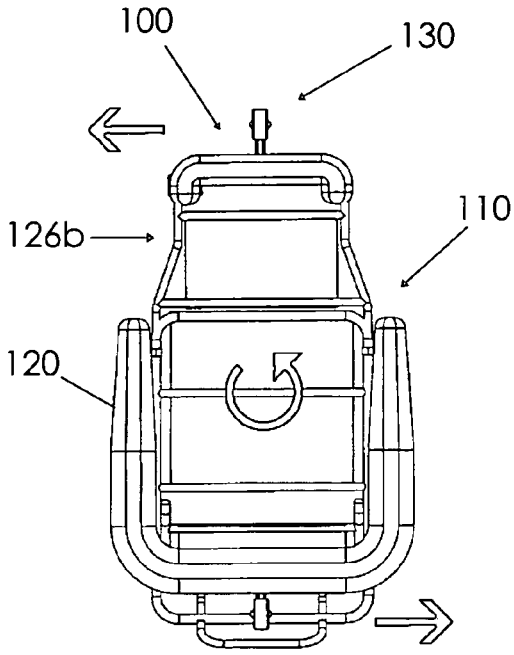
FIGS. 2*a* through 2*d* are top views of the floating chair as in FIG. 1*a* with arrows depicting the direction of travel for the seat member and the maneuvering devices.
Figure 2B:
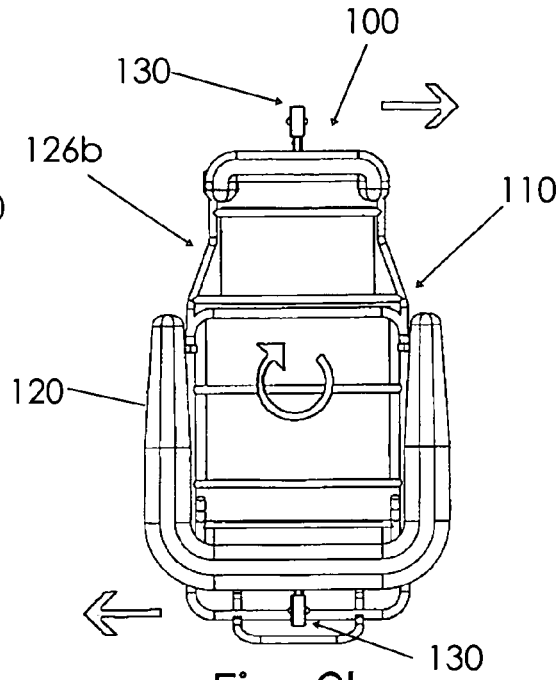
Figure 2C:
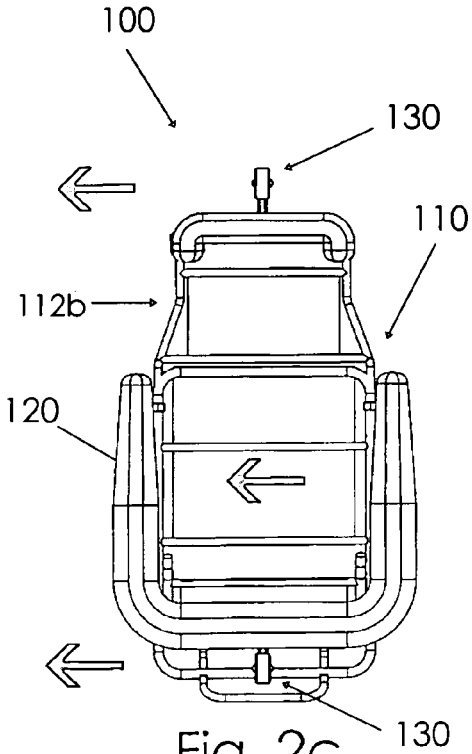
Figure 2D:
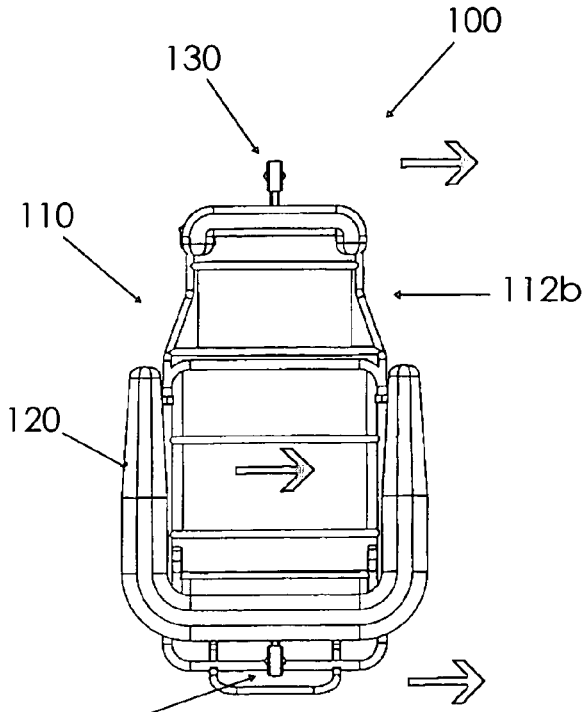

A floating chair according to the present invention will now be described in detail with reference to FIGS. 1*a* through 9 of the accompanying drawings. More particularly, a floating chair 100 includes a seat member 110 for supporting a person and a buoyant member 120 attached to the seat member 110 for maintaining the seat member 110 above a water surface (FIGS. 1*a* and 1*b*).

Figure 3A:
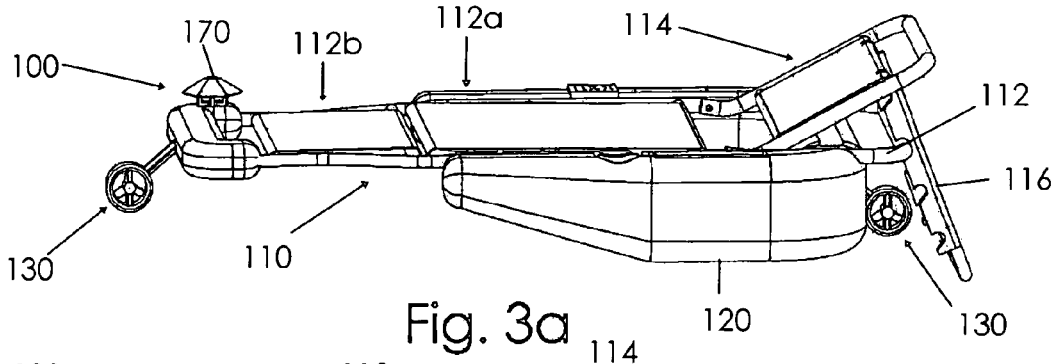
FIG. 3*a* is a perspective view of the floating chair as in FIG. 1*a* at a lounging configuration.
Figure 3B:
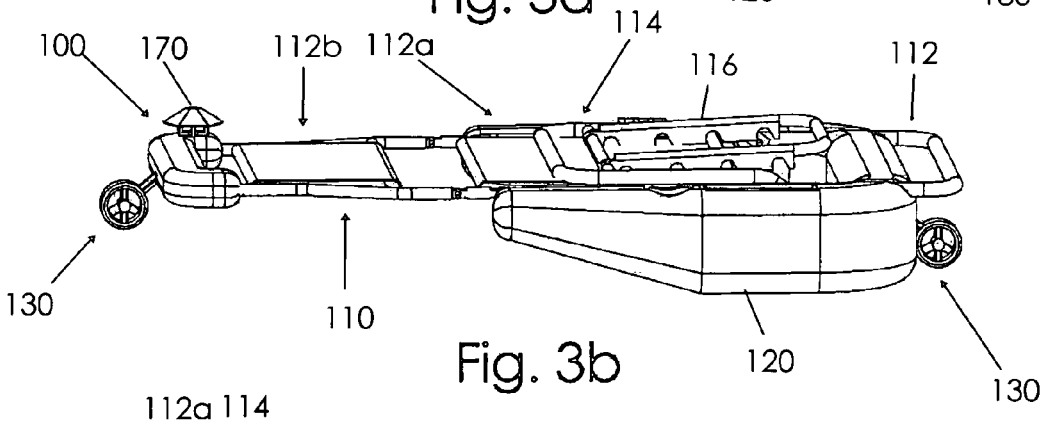
FIG. 3*b* is a perspective view of the floating chair as in FIG. 3*a* with the seat member back portion folded atop the seat member upper leg portion.
Figure 3C:
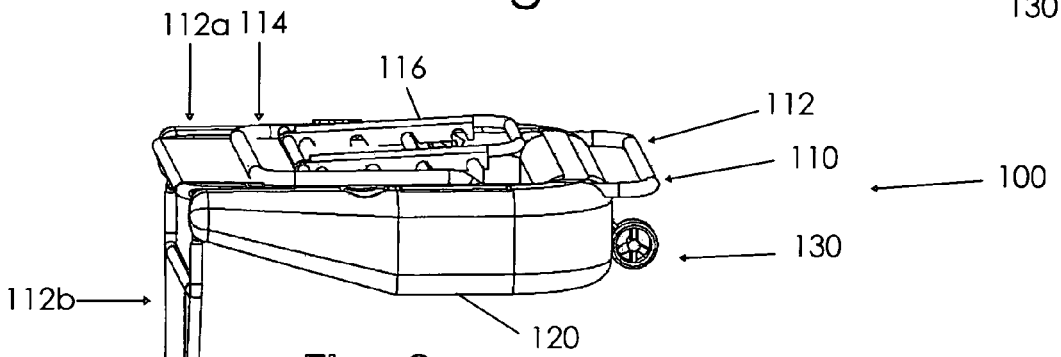
FIG. 3*c* is a perspective view of the floating chair as in FIG. 3*b* with the seat member lower leg portion being folded beneath the seat member upper leg portion.
Figure 3D:
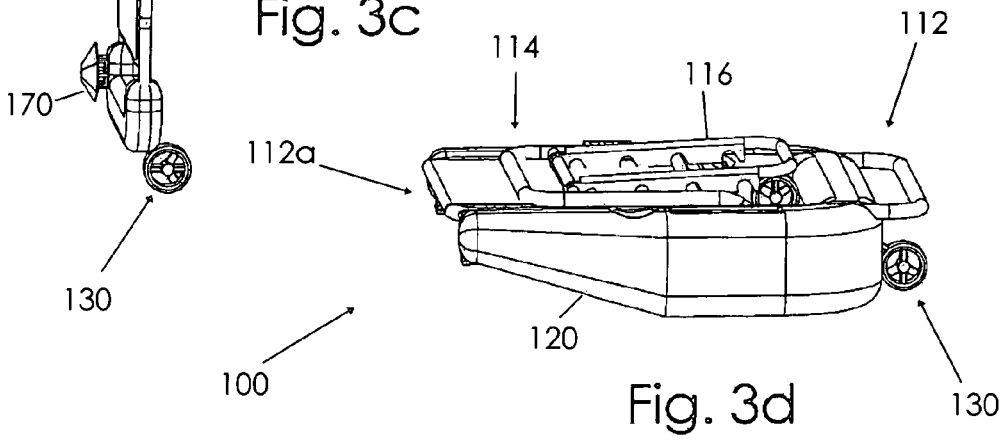
FIG. 3*d* is a perspective view of the floating chair as in FIG. 3*c* at a storage configuration.

The seat member 110 comprises a back portion 114 that is pivotal relative to a leg portion 112. The leg portion 112 comprises an upper leg portion 112*a* and a lower leg portion 112*b*. The back portion 114 is pivotally attached to the upper leg portion 112*a*, and the upper leg portion 112*a* is pivotally attached to the lower leg portion 112*b*. These pivotal attachments allow the seat member to move between a lounging configuration (FIG. 3*a*) and a storage configuration (FIG. 3*d*). The seat member 110 preferably includes a rigid frame 110*a* spanned by a waterproof material 110*b*, has opposed foot and head ends 115*a*, 115*b*, and has top and bottom sides 115*c*, 115*d*.

Figure 4:
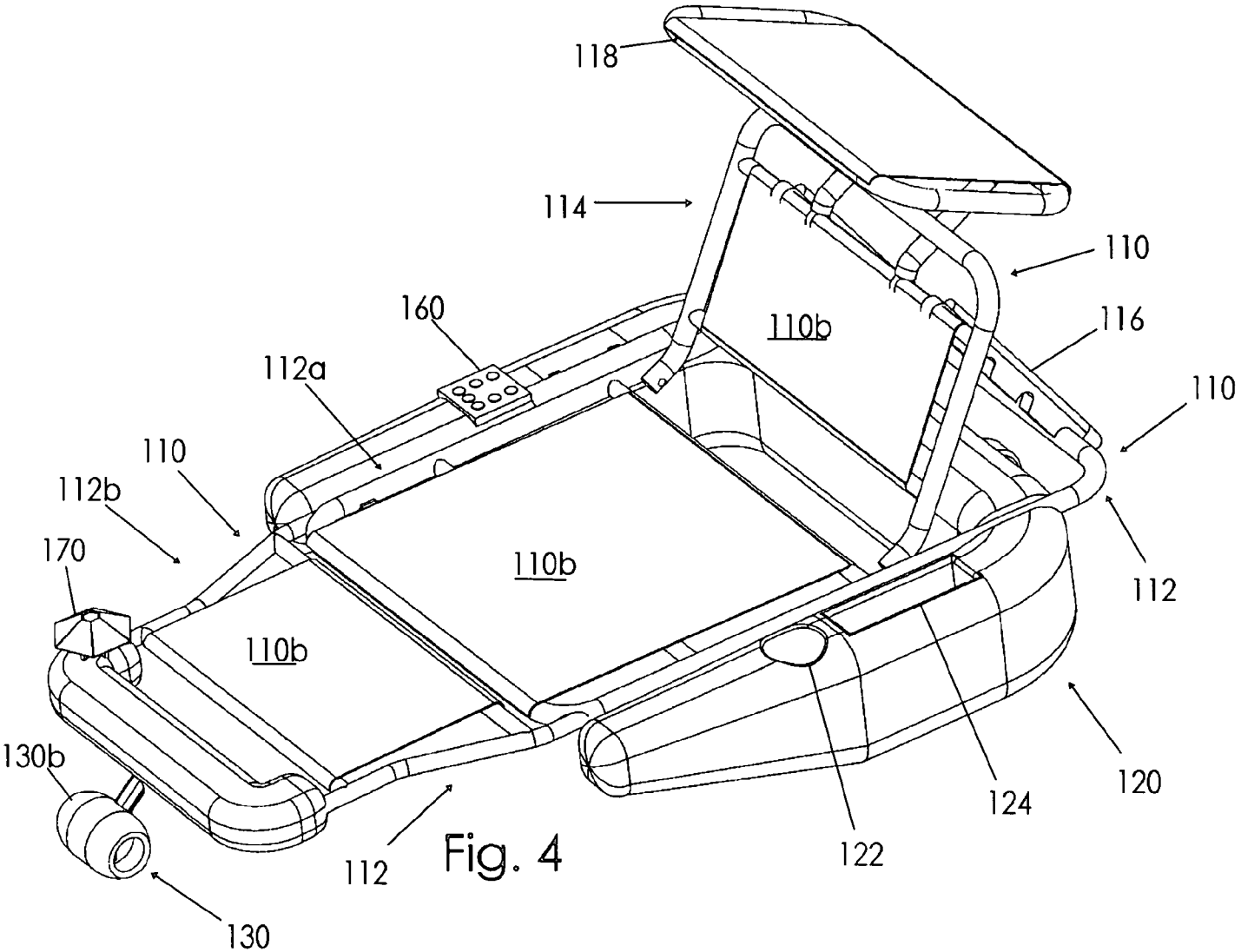
FIG. 4 is a perspective view of the floating chair as in FIG. 1*a* with a shade member.

An adjustment arm 116 is pivotally coupled to the back portion 114 of the seat member 110 (FIG. 1*b*), and a shade member 118 is operatively attached to the seat member 110 for keeping direct sunlight from reaching a user (FIG. 4). The adjustment arm 116 has a plurality of notches 116*a* longitudinally spaced therealong for selectively coupling the adjustment arm 116 to the seat member leg portion 112.

At least one maneuvering device 130 is operatively attached to the seat member 110 and located below the seat member bottom side 115*d*. One maneuvering device 130 is preferably adjacent the seat member foot end 115*a*, and one maneuvering device 130 is preferably adjacent the seat member head end 115*b*. Suitable maneuvering devices 130 may include a propeller 130*a* (FIGS. 1*a* and 1*b*) or an impeller 130*b* (FIG. 4).

Figure 5:
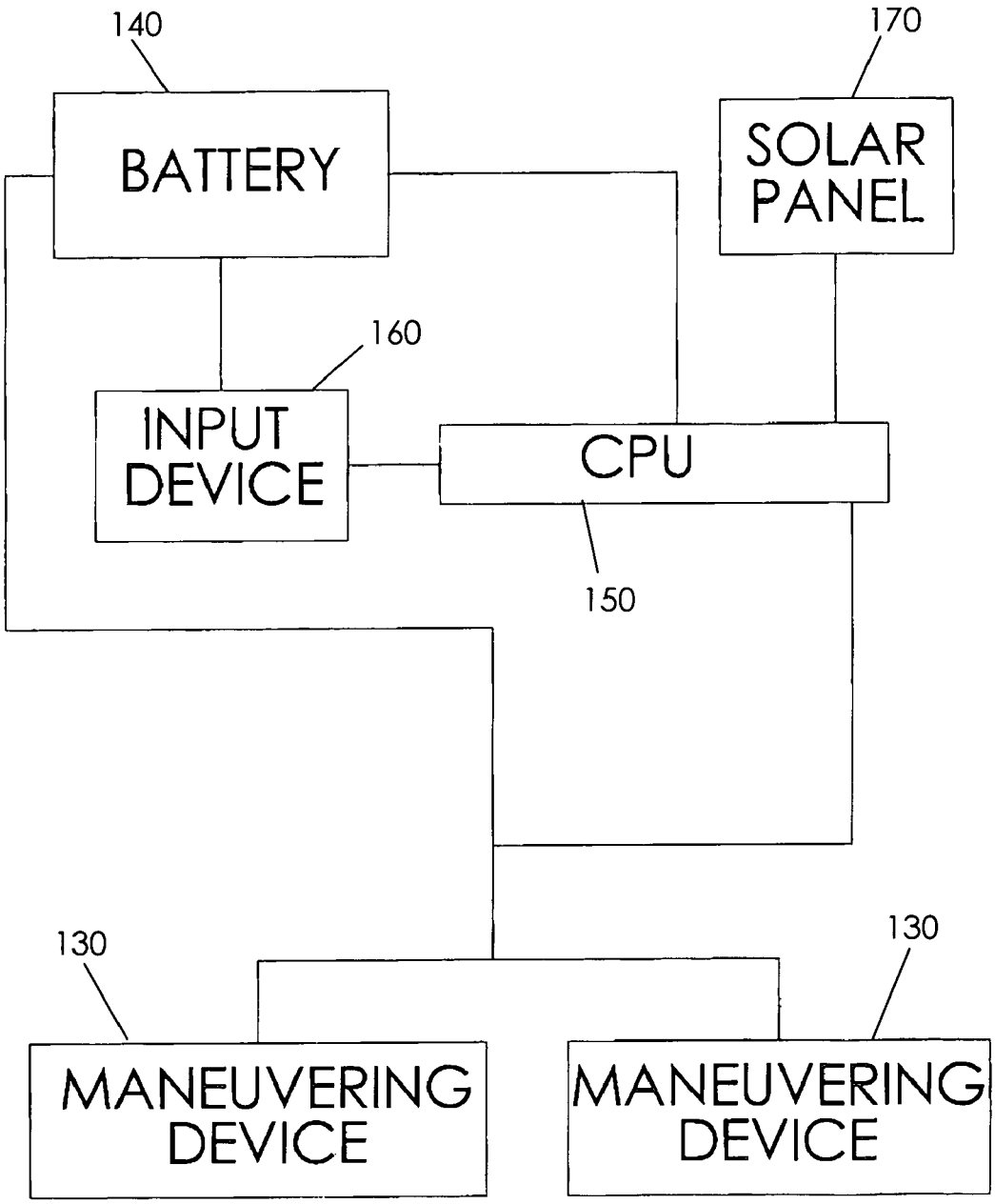
FIG. 5 is a block diagram showing the components of the floating chair as in FIG. 1*a;*
Figure 6:
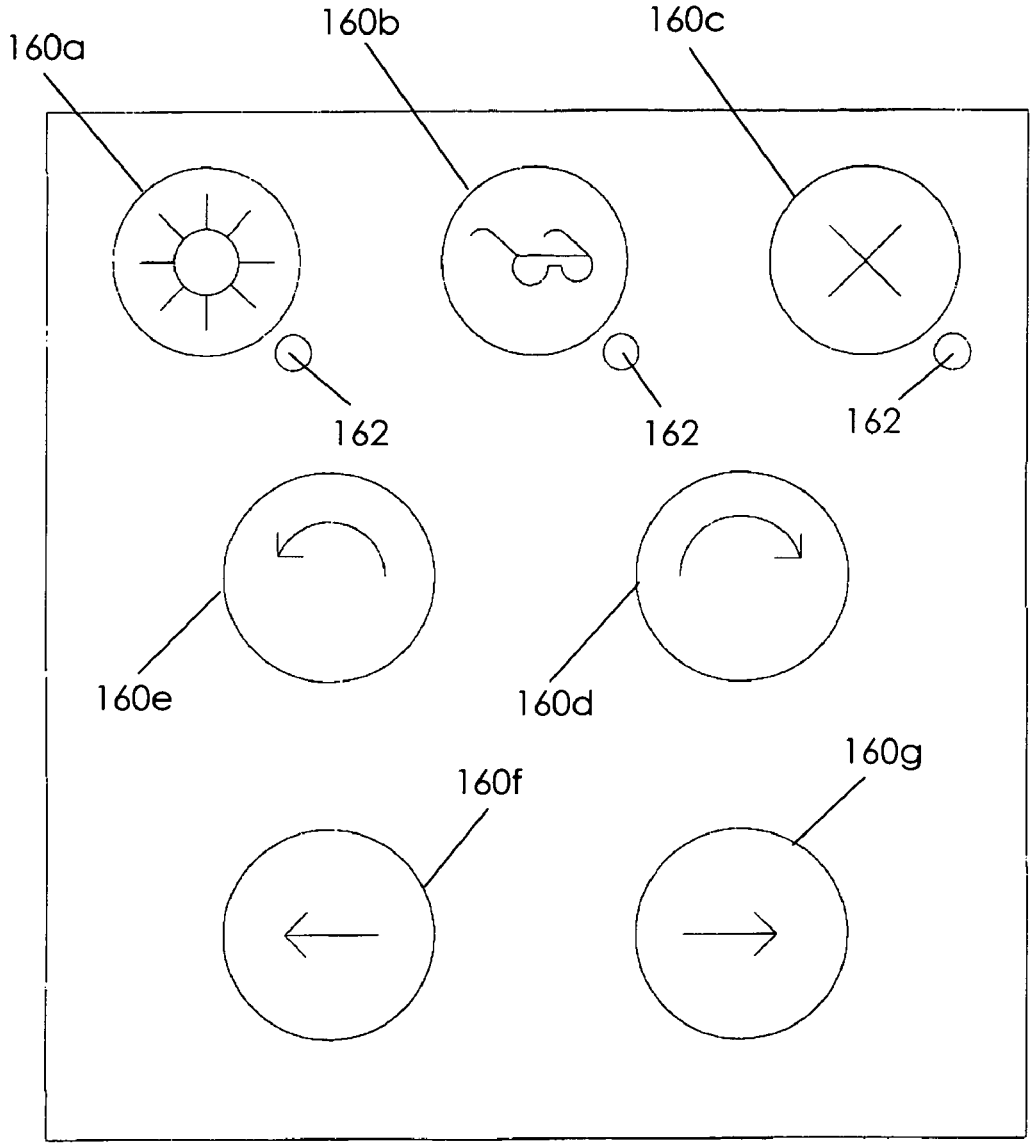
FIG. 6 is a top view of an input device.

A battery 140 is in communication with each maneuvering device 130 for energizing each maneuvering device 130, and a CPU 150 is in communication with each maneuvering device 130 for selectively actuating each maneuvering device 130 (FIG. 5). A solar panel 170 is in communication with the CPU 150 for detecting the location of the sun and conveying sun location data to the CPU 150 (FIG. 5). The solar panel 170 may be electrically connected to the battery 140 for charging the battery 140 with solar energy.

The CPU 150 may include circuitry or programming in communication with the solar panel 170 for determining the position of the seat member 110 relative to the sun and circuitry or programming for automatically actuating at least one maneuvering device 130 to maintain the seat member 110 in a constant position relative to the sun. If the seat member 110 is maintained away from direct sunlight, this may be referred to as a shade mode. If the seat member 110 is maintained in direct sunlight, this may be referred to as a sun mode. The CPU 150 may also include circuitry or programming in communication with the solar panel 170 for determining the position of the seat member 110 relative to a remote object and circuitry or programming for automatically actuating at least one maneuvering device 130 to maintain the seat member 110 in a constant position relative to the remote object. If the seat member 110 is maintained in a constant position relative to a remote object, this may be referred to as a static mode. Further, the CPU 150 may include circuitry or programming for actuating at least one maneuvering device 130 to move the seat member 110 in a clockwise direction, a counterclockwise direction, laterally left, or laterally right.

An input device 160 may be positioned adjacent the seat member 110 and include buttons 160*a*, 160*b*, 160*c* for choosing among the sun mode, the shade mode, and the static mode in the CPU 150, respectively. The input device 160 may include an indicator light 162 for indicating a chosen mode. The input device 160 may also include buttons 160*d*, 160*e*, 160*f*, 160*g* for allowing the user to choose among the clockwise, counterclockwise, lateral left, and lateral right directions in the CPU 150, respectively.

The buoyant member 120 is preferably a rigid, hollow shell constructed of plastic or metal and may include a cup holder 122 or a storage bin 124 (FIG. 1*a*). The CPU 150 is preferably mounted inside the buoyant member 120 to keep the CPU 150 safe and dry, though this need not be the case. Other buoyant members 120 that may be used include inflatable tubes and buoyant foam, among others.

In use, the floating chair 100 is placed on water, such as a pool, a lake, or an ocean. More particularly, the buoyant member 120 floats on the water while the seat member 110 is maintained above the water's surface with the bottom side 115*d* facing the water. The at least one maneuvering device 130 is located below the water surface. The seat member 110 is in the lounging configuration (FIG. 3*a*). The back portion 114 of the seat member 110 may be positioned at one of a plurality of recumbent positions by coupling the adjustment arm 116 to the seat member leg portion 112, and a user may sit on the seat member 110. The user may use the input device 160 to select the sun mode, the shade mode, or the static mode in the CPU 150 or to select the clockwise, counterclockwise, lateral left, or lateral right directions in the CPU 150. If a mode is selected, the indicator light 162 will indicate the selection.

Figure 8:
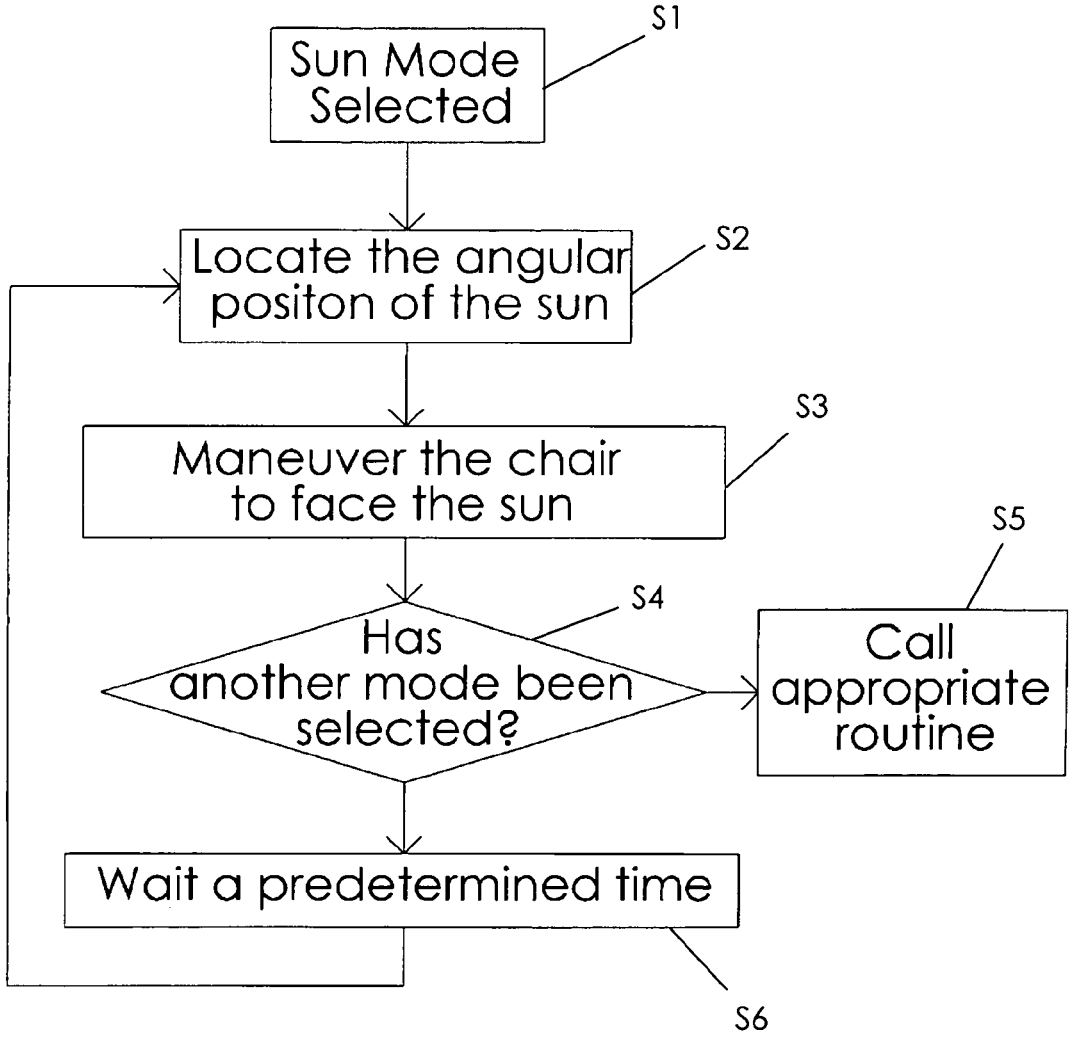
FIG. 8 is a flowchart illustrating the logic performed by the CPU when sun mode is selected.

An example of the logic performed by the CPU 150 when the sun mode is selected is shown in the flowchart on FIG. 8.

In process step S1, the CPU 150 recognizes that the user has selected the sun mode using the input device 160 and begins the sun mode. The process then proceeds to step S2, where the CPU 150 locates the angular position of the sun. The angular position of the sun may be located using the sun location data from the solar panel 170. This sun location data may correspond to the amount of current produced when the solar panel 170 is pointing in various directions or to the amount of current produced from various parts of the solar panel 170 that point in multiple directions. The solar panel 170 produces more current when more light hits its surface. The process then proceeds to step S3.

In process step S3, the CPU 150 actuates at least one maneuvering device 130 to cause the seat member 110 to face the sun. The process then proceeds to step S4.

In process step S4, the CPU 150 determines if another mode (shade or static) has been selected. If so, the process is directed to step S5. If not, the process is directed to step S6.

In process step S5, the CPU 150 exits the sun mode and begins the appropriate mode.

In process step S6, the CPU 150 waits a predetermined time and returns to process step S2, creating a loop.

Figure 9:
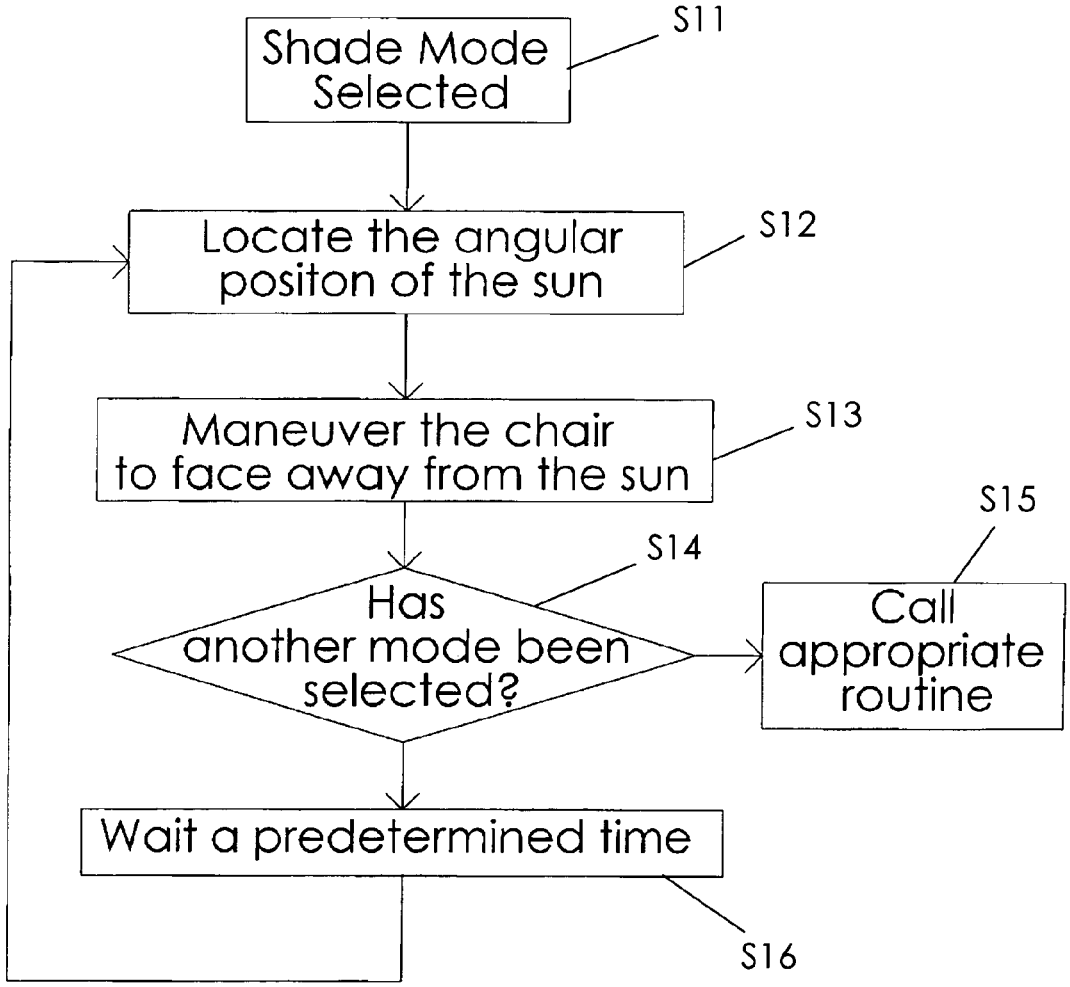
FIG. 9 is a flowchart illustrating the logic performed by the CPU when shade mode is selected.

An example of the logic performed by the CPU 150 when the shade mode is selected is shown in the flowchart on FIG. 9.

In process step S11, the CPU 150 recognizes that the user has selected the shade mode using the input device 160 and begins the shade mode. The process then proceeds to step S12, where the CPU 150 locates the angular position of the sun. The angular position of the sun may be located as described in step S2 above. The process then proceeds to step S13.

In process step S13, the CPU 150 actuates at least one maneuvering device 130 to cause the seat member 110 to face away from the sun. The process then proceeds to step S14.

In process step S14, the CPU 150 determines if another mode (sun or static) has been selected. If so, the process is directed to step S15. If not, the process is directed to step S16.

In process step S15, the CPU 150 exits the shade mode and begins the appropriate mode.

In process step S16, the CPU 150 waits a predetermined time and returns to process step S12, creating a loop.

Figure 7:
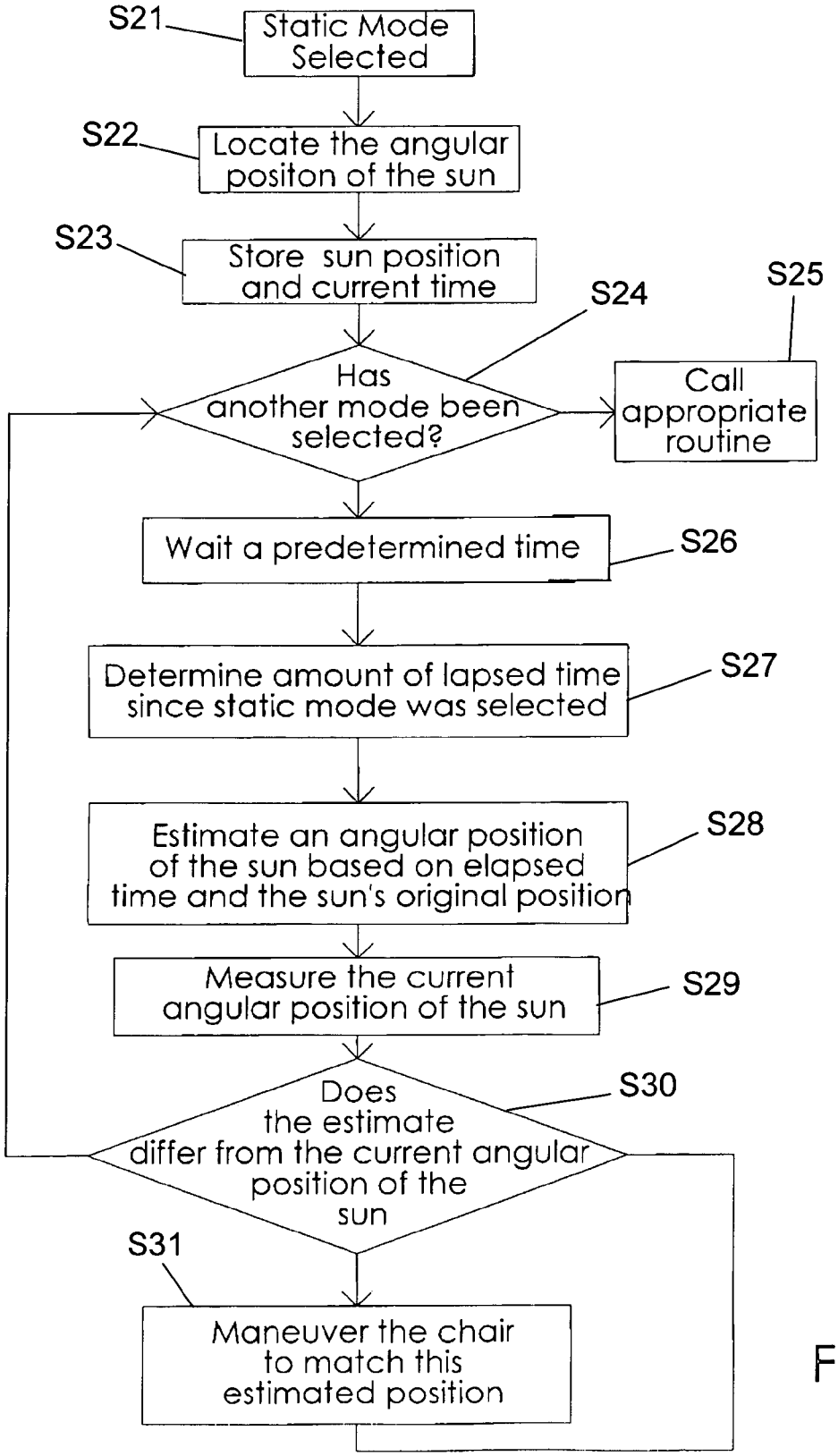
FIG. 7 is a flowchart illustrating the logic performed by the CPU when static mode is selected.

An example of the logic performed by the CPU 150 when the static mode is selected is shown in the flowchart on FIG. 7.

In process step S21, the CPU 150 recognizes that the user has selected the static mode using the input device 160 and begins the static mode. The process then proceeds to step S22, where the CPU 150 locates the angular position of the sun. The angular position of the sun may be located as described in step S2 above. The process then proceeds to step S23, where the CPU 150 stores the current time and sun location data. The process then proceeds to step S24.

In process step S24, the CPU 150 determines if another mode (sun or shade) has been selected. If so, the process is directed to step S25. If not, the process is directed to step S26.

In process step S25, the CPU 150 exits the static mode and begins the appropriate mode.

In process step S26, the CPU 150 waits a predetermined time. The process then proceeds to step S27.

In process step S27, the CPU 150 determines the amount of lapsed time since the static mode was selected (step S21). The process then proceeds to step S28, where the CPU 150 estimates an angular position of the sun based on the elapsed time and the sun's original position. The process then proceeds to step S29.

In step S29, the CPU 150 locates the current angular position of the sun. The process then proceeds to step S30.

In process step S30, the CPU 150 determines if the current angular position of the sun differs from the estimated angular position of the sun. If so, the process is directed to step S31. If not, the process is directed to step S24, creating a loop.

In process step S31, the CPU 150 actuates at least one maneuvering device 130 to match the estimated angular position of the sun. The process then returns to step S30.

If the user selects the clockwise, counterclockwise, lateral left, or lateral right directions in the CPU 150, the CPU 150 actuates at least one maneuvering device 130 appropriately. FIGS. 2*a*, 2*b*, 2*c*, and 2*d* depict the direction of travel for a seat member 110 and its two maneuvering devices 130 when counterclockwise, clockwise, lateral left, and lateral right are selected, respectively.

When the floating chair is not in use, the seat member 110 may be moved from the lounging configuration (FIG. 3*a*) to the storage configuration (FIG. 3*d*). First, the adjustment arm 116 may be uncoupled from the seat member leg portion 112, and the seat member back portion 114 may be folded atop the seat member upper leg portion 112*a* (FIG. 3*b*). The seat member lower leg portion 112*b* may be folded beneath the seat member upper leg portion 112*a*. FIG. 3*c* shows the seat member lower leg portion 112*b* being folded. When the seat member 110 reaches the storage configuration (FIG. 3*d*), the floating chair 100 is compact and requires minimal storage space. Wheels may be added to ease transportation (not shown).

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A floating chair, comprising:

a seat member for supporting a person;

a buoyant member attached to said seat member for maintaining said seat member above a water surface;

a maneuvering device operatively attached to said seat member and located below a bottom side of said seat member;

a battery in communication with said maneuvering device for energizing said maneuvering device;

a CPU in communication with said maneuvering device for selectively actuating said maneuvering device; and a solar panel in communication with said CPU for detecting the location of the sun and conveying sun location data to said CPU.

2. The floating chair as in claim 1, wherein said seat member includes a rigid frame and a waterproof material spanning said rigid frame.

3. The floating chair as in claim 1, wherein said seat member comprises a leg portion and a back portion, said back portion being pivotal relative to said leg portion.

4. The floating chair as in claim 3, further comprising an adjustment arm pivotally coupled to said back portion of said seat members said adjustment arm having a plurality of notches longitudinally spaced therealong for selectively coupling said adjustment arm to said leg portion, whereby to selectively position said back portion at a plurality of recumbent positions.

5. The floating chair as in claim 1, wherein:

said seat member comprises a back portion, an upper leg portion, and a lower leg portion; and said back portion is pivotally attached to said upper leg portion and said lower leg portion is pivotally attached to said upper leg portion for movement of said seat member between a lounging configuration and a storage configuration.

6. The floating chair as in claim 1, further comprising a shade member operatively attached to said seat member for keeping direct sunlight from reaching a user.

7. The floating chair as in claim 1, wherein said maneuvering device includes a propeller.

8. The floating chair as in claim 1, wherein said maneuvering device includes an impeller.

9. The floating chair as in claim 1, wherein said CPU includes means for determining the position of said seat member relative to the sun and means for automatically actuating said maneuvering device to maintain said seat member in a constant position relative to the sun.

10. The floating chair as in claim 1, wherein said CPU includes means for determining the position of said seat member relative to a remote object and means for automatically actuating said maneuvering device to maintain said seat member in a constant position relative to said remote object.

11. The floating chair as in claim 1, further comprising an input device positioned adjacent said seat member for choosing among a sun mode, a shade mode, and a static mode in said CPU.

12. The floating chair as in claim 1, wherein said solar panel is electrically connected to said battery for charging said battery with solar energy.

13. The floating chair as in claim 1, wherein:

said seat member has opposed foot and head ends; and said maneuvering device is adjacent said foot end.

14. The floating chair as in claim 13, further comprising a second maneuvering device operatively attached to said seat member adjacent said head end and located below a bottom side of said seat member, and wherein:

said battery is in communication with said second maneuvering device for energizing said second maneuvering device; and said CPU is in communication with said second maneuvering device for selectively actuating said second maneuvering device.

15. A floating chair, comprising:

a seat member for supporting a person;

a buoyant member attached to said seat member for maintaining said seat member atop a water surface;

a plurality of maneuvering devices operatively attached to said seat member and positioned below a bottom side of said seat member;

a battery in communication with said plurality of maneuvering devices for energizing said a plurality of maneuvering devices;

a CPU in communication with said plurality of maneuvering devices for selectively actuating said maneuvering devices; and a solar panel in communication with said CPU for detecting the location of the sun and conveying sun location data to said CPU, said solar panel being electrically connected to said battery for charging said battery with solar energy.

16. The floating chair as in claim 15, further comprising an input device positioned adjacent said seat member for choosing among a sun mode, a shade mode, and a static mode in said CPU.

17. The floating chair as in claim 15, wherein said CPU includes means for determining the position of said seat member relative to the sun and means for automatically actuating selective said maneuvering devices to maintain said seat member in a constant position relative to the sun.

18. The floating chair as in claim 15, wherein said CPU includes means for determining the position of said seat member relative to a remote object and means for automatically actuating selective said maneuvering devices to maintain said seat member in a constant position relative to said remote object.

19. The floating chair as in claim 15, wherein:

said seat member comprises a back portion, an upper leg portion, and a lower leg portion; and said back portion is pivotally attached to said upper leg portion and said lower leg portion is pivotally attached to said upper leg portion for movement of said seat between a lounging configuration and a storage configuration.

20. The floating chair as in claim 19, wherein:

said CPU includes means for determining the position of said seat member relative to the sun and means for automatically actuating selective said maneuvering devices to maintain said seat member in a constant position relative to the sun; and said CPU includes means for determining the position of said seat member relative to a remote object and means for automatically actuating selective said maneuvering devices to maintain said scat member in a constant position relative to said remote object.

* * * * *